US008899948B2

(12) United States Patent
Shin et al.

(10) Patent No.: US 8,899,948 B2
(45) Date of Patent: Dec. 2, 2014

(54) FRETTING-CORROSION-PREVENTION OSCILLATING VANE TYPE PUMP ACTUATOR

(75) Inventors: Seung-Ho Shin, Daejeon (KR); Key-Yong Hong, Daejeon (KR); Tomiji Watabe, Hokkaido (JP)

(73) Assignee: Korea Ocean Research and Development Institute, Gyeonggi-Do (KR)

( * ) Notice: Subject to any disclaimer, the term of this patent is extended or adjusted under 35 U.S.C. 154(b) by 157 days.

(21) Appl. No.: 13/512,545

(22) PCT Filed: Apr. 14, 2011

(86) PCT No.: PCT/KR2011/002686

§ 371 (c)(1), (2), (4) Date: May 29, 2012

(87) PCT Pub. No.: WO2011/129642

PCT Pub. Date: Oct. 20, 2011

(65) Prior Publication Data

US 2012/0237384 A1 Sep. 20, 2012

(30) Foreign Application Priority Data

Apr. 17, 2010 (JP) ..... 2010-108717
Apr. 11, 2011 (KR) ..... 10-2011-0033138

(51) Int. Cl.
*F01C 3/00* (2006.01)
*F03C 2/00* (2006.01)

(Continued)

(52) U.S. Cl.
CPC ..... *F04C 13/005* (2013.01); *F04C 2280/04* (2013.01); *F04C 2240/805* (2013.01);

(Continued)

(58) Field of Classification Search
CPC ..... F03C 4/00; F04C 13/005; F04C 9/002; F15B 15/12
USPC ..... 418/259, 195, 53, 68, 183, 185–187, 418/225, 227; 366/279; 123/90.15, 90.17, 123/90.31
See application file for complete search history.

(56) References Cited

U.S. PATENT DOCUMENTS 4,027,475 A * 6/1977 Folsom ..... 60/369
6,532,921 B2 * 3/2003 Sato et al. ..... 123/90.17

(Continued)

FOREIGN PATENT DOCUMENTS

JP 09126158 A 5/1997
JP 2001271735 A 10/2001

(Continued)

OTHER PUBLICATIONS

"PCT International Search Report dated Nov. 17, 2011 for PCT/KR2011/002686, from which the instant application is based," 2 pgs.

*Primary Examiner* — Kenneth Bomberg
*Assistant Examiner* — Deming Wan
(74) *Attorney, Agent, or Firm* — Fredrikson & Byron, PA

(57) ABSTRACT

Disclosed herein is an oscillating vane type pump actuator. The pump actuator of the present invention provides a method of preventing fretting corrosion from being caused on joined surfaces of elements. A cylinder (3*c*) has a comparatively low radial strength, and each of side covers (1*c*) and (2*c*) has a high radial strength. A cylindrical portion (1*c-c*), (2*c-c*) is provided on each side cover. Thus, when high pressure of work oil distorts the cylinder into a shape in which the cross-section of the cylinder becomes an ellipse-like shape, the cylindrical portions of the side covers act such that they are distorted in the same shape as that of the cylinder. Further, a passage that always communicates with a low-pressure side working chamber is formed in the contact surfaces between a fixed vane that is fixed to the cylinder and the side covers.

1 Claim, 5 Drawing Sheets

(51) Int. Cl.

| | |
|---|---|
| ***F03C 4/00*** | (2006.01) |
| ***F04C 2/00*** | (2006.01) |
| ***F04C 3/00*** | (2006.01) |
| ***F04C 18/00*** | (2006.01) |
| ***F01C 21/00*** | (2006.01) |
| ***F04C 13/00*** | (2006.01) |
| ***F04C 21/00*** | (2006.01) |
| ***F04C 15/00*** | (2006.01) |
| ***F04C 29/00*** | (2006.01) |
| ***F01C 1/00*** | (2006.01) |
| ***F25B 15/12*** | (2006.01) |
| ***F04C 9/00*** | (2006.01) |

(52) U.S. Cl.

CPC ..... *F25B 15/12* (2013.01); *F04C 9/002* (2013.01); *F04C 2240/30* (2013.01); *F03C 4/00* (2013.01)

USPC ..... 418/68; 418/72; 418/185; 418/186; 418/225

(56) References Cited

U.S. PATENT DOCUMENTS

2009/0291000 A1* 11/2009 Saga et al. ..... 417/364
2010/0028181 A1* 2/2010 Mathers ..... 418/1

FOREIGN PATENT DOCUMENTS

JP 2002168180 A 6/2002
JP 2004339988 A 12/2004
JP 2005307821 A 11/2005

* cited by examiner

C — D

FRETTING-CORROSION-PREVENTION OSCILLATING VANE TYPE PUMP ACTUATOR

RELATED APPLICATIONS

This application is a 35 U.S.C. 371 national stage filing from International Application No. PCT/KR2011/002686 filed Apr. 14, 2011, and claims priority to Korean Application No. 10-2011-0033138 filed Apr. 11, 2011 and to Japanese Application No. 2010-108717 filed Apr. 17, 2010, the teachings of all of which are incorporated herein by reference.

TECHNICAL FIELD

The present invention relates, in general, to oscillating vane type pump actuators which realize a high power oscillating drive using high-pressure work oil as a power conversion means and, more particularly, to an improved high-pressure oscillating vane type pump actuator which can provide effective measures to solve problems caused in an apparatus which has proved the efficiency of the wave-power generation to be markedly enhanced using an oscillating vane type pump actuator that can be used in high pressure of 25 Mpa.

BACKGROUND ART

The inventor of the present invention has strived to develop wave-power generation systems having high energy efficiency from when he worked at the Muroran Industry College of Japan. In detail, it pertains to using wave power having two kinds of complex motion mechanisms including vertical and horizontal motions. An oscillating plate is installed at a singular point at which interference between incident waves and reflected waves occurs, particularly, at a singular point at which vertical motion becomes zero while horizontal kinetic energy is doubled. Thereby, it is intended to provide a rational wave-power generation method, in particular, a pendulum wave-power generation method in which a generator using a hydraulic system can be efficiently operated.

In Japan, there are not many engineers who try to actively understand and use wave interference which is one of the fundamental notions of physics and has been disclosed in Patent document 1. Thus, there are very few people who recognize the achievements of the research of the inventor of the present invention. With regard to this, on the open sea, the energy efficiency of a practical apparatus using the high efficiency wave-power generation method was about 42% which is the world's highest.

The first practical apparatus to be manufactured by the inventor of the present invention as a hydraulic pump device for converting oscillating motion of the pendulum plate into rotary motion of a generator was a system using a large hydraulic cylinder. However, when the hydraulic cylinder is used, the power of impacting waves is applied to the pendulum plate and may cause fatigue failure of a cylinder mounting member or hinge pin. Further, in severe conditions of the open sea, a lubricant unit may malfunction. Therefore, to avoid the above problems, a simple power conversion mechanism which can withstand the severe natural conditions and has no dispensable member is required. A solution for this is to provide an oscillating vane type pump actuator which is integrally provided on an oscillating shaft of the pendulum plate and to limit the members which must maintain lubricating performance in the midst of severe natural conditions to a pair of bearings which support the oscillating shaft of the pendulum plate. In the case of the bearings, it is easy to maintain the lubricant performance. Mounting members integrated with the bearings are also strong. Thus, most of the problems can be solved. However, because the pressure resistance of oscillating vane pumps which have been commercialized is typically low, it is necessary to increase the pressure resistance two or three fold. The inventor of the present invention has also striven to solve such problems and has proposed a detailed technique of Patent document 2 which can be used even in pressure of 25 Mpa. As a result, the inventor of the present invention realized the development of a hydraulic high power conversion apparatus which is compact and has superior durability even in severe sea conditions. Moreover, based on such achievements, it has become increasingly possible for a large oscillating vane type pump actuator having specifications for high-pressure to also be used in a wave-power generation method using motion of a floating body, which has recently been attracting attention.

Typically, conventional hydraulic systems have simple valve structures which can control high power but consume a lot of energy. Recently, the age of technological innovation which highly evaluates energy saving technology has come about, so the hydraulic systems have changed into an electric-powered structure, and there has been a reduction in the market for hydraulic systems. Here, an advancement into new fields which has not been achieved by the conventional technology will be one of the best ways to counteract the shrinking of the market. A representative example of this is an oscillating actuator which can be used in a hinge unit of a large robot arm. For example, this can be used in a high-rise work for construction of a large windmill which uses natural energy. In the construction work of the large windmill, it is difficult to use an electric-powered structure, because the output of an electric motor is typically not sufficient.

As another field in which it is expected to be able to use the high-pressure oscillating vane actuator, the actuator may be used as an oscillating actuator for a steering device of a large ship. However, the oscillating vane actuator which is available on the market is a low pressure/small capacity actuator of 14 Mpa or less and cannot meet requirements of the shipbuilding or shipping industry which pursue minimization of space required to install the actuator.

DISCLOSURE

Technical Problem

Accordingly, the present invention has been made keeping in mind the above problems occurring in the prior art, and an object of the present invention is to provide an oscillating vane type pump actuator which has an improved structure that can prevent the abrasion of mounting surfaces of main elements and, more particularly, to prevent fretting corrosion on junction surfaces between a cylinder and side covers that define the hydraulic working chamber of the oscillating vane type pump actuator and on contact surfaces between a fixed vane provided on the cylinder and the side covers.

The reason the above problems occur is believed to be that the axial strength and radial strength of the cylinder are inversely related to those of the disk-like side covers, so that the difference in torsion on the junctions between the cylinder and the side covers that is caused by high-pressure of work oil applied to the working chamber is comparatively large. In other words, it is believed that there is a difference in directional strength between the cylinder and the side covers, that is, the cylinder has high axial strength but low radial strength, while each disk-like side cover has high radial strength but low axial strength, and that this is the fundamental cause of the problems.

[Patent document 1] Japanese Patent No. 2001-271735 (Application No. 2000-128632)

[Patent document 2] Japanese Patent No. 2002-168180 (Application No. 2000-403806)

Technical Solution

In order to accomplish the above object, the present invention is configured such that the lengths of opposite ends of a cylinder are shortened and a cylindrical part that protrudes towards the cylinder is provided on each side cover to make up for the shortened cylinder. Furthermore, at junction surfaces between a fixed vane and the side covers, to mitigate excessive pressure applied to the junction surfaces, a passage that always communicates with a low-pressure side working chamber is formed in the surface that is enclosed by a seal provided on a joined surface of the fixed vane that is joined to each side cover. Thus, the side covers and the fixed vane are put into contact with each other by oil films at pressures lower than that of the conventional technology, thereby allowing deformation attributable to a relative distortion direction difference.

Advantageous Effects

According to the present invention, the cylinder is shorter than that of the conventional technology, and a cylindrical part is provided on each side cover to make up for the shortened cylinder. Therefore, on the junction between the cylinder and the side covers that have different directional strengths and are coupled to each other by bolts or the like, even when high pressure applied into the working chamber causes ellipse-like distortion of the cylinder, the surfaces of the side covers that are joined to the cylinder are distorted in the same manner as that of the cylinder unlike the form of distortion of the side cover body, because the cylindrical part has the same shape as that of the cylinder. In the present invention, the relative distortion rate of the cylinder and the side covers can be limited to 20 μm to 30 μm, so that the fretting corrosion on the junction surfaces between them can be reliably prevented.

The same pressure can be maintained over the entire area of a contact surface between a fixed vane and the cylinder to which the fixed vane is fixed by a bolt or key, as well as contact surfaces between the fixed vane and the side covers, thanks to the use of a passage that communicates with the working chambers. In the passage, a check valve prevents a high-pressure side working chamber from communicating with the passage and allows a low-pressure side working chamber from communicating with the passage, so that a low pressure state can always be maintained, and the contact surfaces between the side covers and the fixed vane are brought contact with each other by a thin oil film. As a result, even if there is a difference in relative distortion between them, stress applied to the contact surfaces in the direction of the distortion is relatively low, thus preventing fretting corrosion that may be caused by fine oscillation between the elements that are strongly joined to each other.

DESCRIPTION OF THE REFERENCE NUMERALS IN THE DRAWINGS

Figure 1:
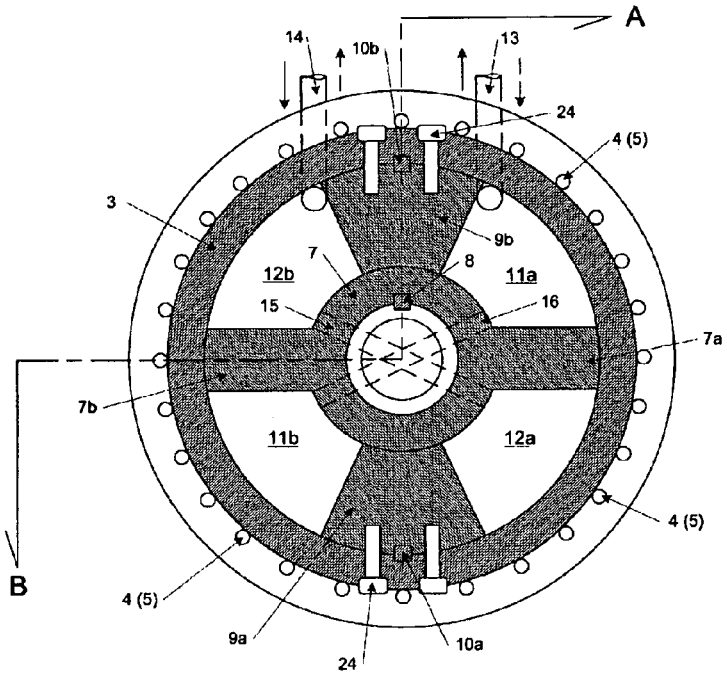
FIG. 1 is a cross-sectional view showing a central portion of a conventional oscillating vane type pump actuator from in the axial direction.

1, 2: side cover of conventional oscillating vane type pump actuator

1*a*, 2*a*: bearing of oscillating shaft of conventional oscillating vane type pump actuator

1*d*, 2*d*: contact surface between side covers and a cylinder of a conventional oscillating vane type pump actuator

3: cylinder of conventional oscillating vane type pump actuator

4, 5: side cover/cylinder connection bolts of conventional oscillating vane type pump actuator

6: oscillating shaft of conventional oscillating vane type pump actuator

7: rotor of conventional oscillating vane type pump actuator

7*a*, 7*b*: oscillating vane of conventional oscillating vane type pump actuator

8: rotor shaft key of conventional oscillating vane type pump actuator

9*a*, 9*b*: fixed vane of conventional oscillating vane type pump actuator

10*a*, 10*b*: key for fixed vane of conventional oscillating vane type pump actuator

11*a*, 11*b*: a pair of working chambers connected to each other by a connection hole in a conventional oscillating vane type pump actuator

12*a*, 12*b*: another pair of working chambers connected to each other by a connection hole in a conventional oscillating vane type pump actuator

13, 14: pipes connecting working chambers that increase and reduce in volume in a hydraulic system in a conventional oscillating vane type pump actuator

15, 16: connection hole communicating interlocking working chambers with each other in a conventional oscillating vane type pump actuator

17, 18: contact surface between side cover and fixed vane of a conventional oscillating vane type pump actuator

1*c*, 2*c*: side cover of oscillating vane type pump actuator of the present invention

1*c*-*a*, 2*c*-*a*: bearing of oscillating shaft of oscillating vane type pump actuator of the present invention

1*c*-*c*, 2*c*-*c*: cylindrical part of side cover of oscillating vane type pump actuator of the present invention

1*c*-*d*, 2*c*-*d*: contact surface between cylinder and cylindrical part of side cover of the present invention
3*c*: cylinder of an oscillating vane type pump actuator of the present invention
4*c*, 5*c*: connection bolt of cylinder and side cover
6*c*: oscillating shaft of an oscillating vane type pump actuator of the present invention
7*c*: rotor of an oscillating vane type pump actuator of the present invention
7*c*-*a*, 7*c*-*b*: oscillating vane of an oscillating vane type pump actuator of the present invention
8*c*: rotor shaft key of the present invention
9*c*-*a*, 9*c*-*b*: fixed vane of an oscillating vane type pump actuator of the present invention
10*c*-*a*, 10*c*-*b*: key of fixed vane of the present invention
11*c*-*a*, 11*c*-*b*: a pair of interlocking working chambers of an oscillating vane type pump actuator of the present invention
12*c*-*a*, 12*c*-*b*: another pair of interlocking working chambers of an oscillating vane type pump actuator of the present invention
13*c*, 14*c*: pipes connecting working chambers that increase and reduce in volume in a hydraulic system according to the present invention
15*c*, 16*c*: connection hole communicating interlocking working chambers with each other according to the present invention
17*c*, 18*c*: contact surface between a side cover and fixed vane of the present invention
19*c*-*a*, 19*c*-*b*: slide surface between a rotor and fixed vane of the present invention
20*c*-*a*, 20*c*-*b*: contact surface between a cylinder and fixed vane of the present invention
21, 22: check valve provided in a fixed vane of the present invention
23: passage passing through opposite side surface of a fixed vane in contact with side covers according to the present invention
24: mounting bolt of a fixed vane
25: rotary seal
40*c*-1, 40*c*-2: fixed seal provided between cylinder and a fixed vane according to the present invention
41*c*-1, 41*c*-2, 41*c*-3: fixed seal provided on contact surface of side cover installed on a fixed vane according to the present invention
42*c*-1, 42*c*-2: rotor slide seal provided on a fixed vane according to the present invention
43*c*-1, 43*c*-2, 43*c*-3, 43*c*-4: fixed seal end pin of contact surface of a side cover of fixed vane according to the present invention
44*c*-1, 44*c*-2: coil spring compressing fixed seal end pin of fixed vane according to the present invention
45, 46: connection pipe between oscillating vane pump and hydraulic system in example in which an oscillating vane type pump actuator of the present invention is used in a pendulum type wave-power generating apparatus
47: wave surface
48: pendulum plate receiving wave power in a pendulum type wave-power generating apparatus
49: oscillating shaft bearing of a pendulum type wave-power generating apparatus
50: oscillating vane pump of an example in which an oscillating vane type pump actuator of the present invention is used in wave-power generating apparatus
51: concrete caisson of a pendulum type wave-power generating apparatus
52: opening of caisson
53: fixed wall of caisson
54: spherical bearing of oscillating shaft of wave-power generating apparatus
55: bearing of oscillating shaft of wave-power generating apparatus
56, 56': support rod connecting pendulum plate to oscillating shaft of pendulum type wave-power generating apparatus
60: actuator of example in which oscillating vane type pump actuator of the present invention is used to control rudder of large ship
61: main rudder shaft
62: rudder

BEST MODE

Hereinafter, the present invention will be described in detail with reference to the attached drawings.

Figure 2:
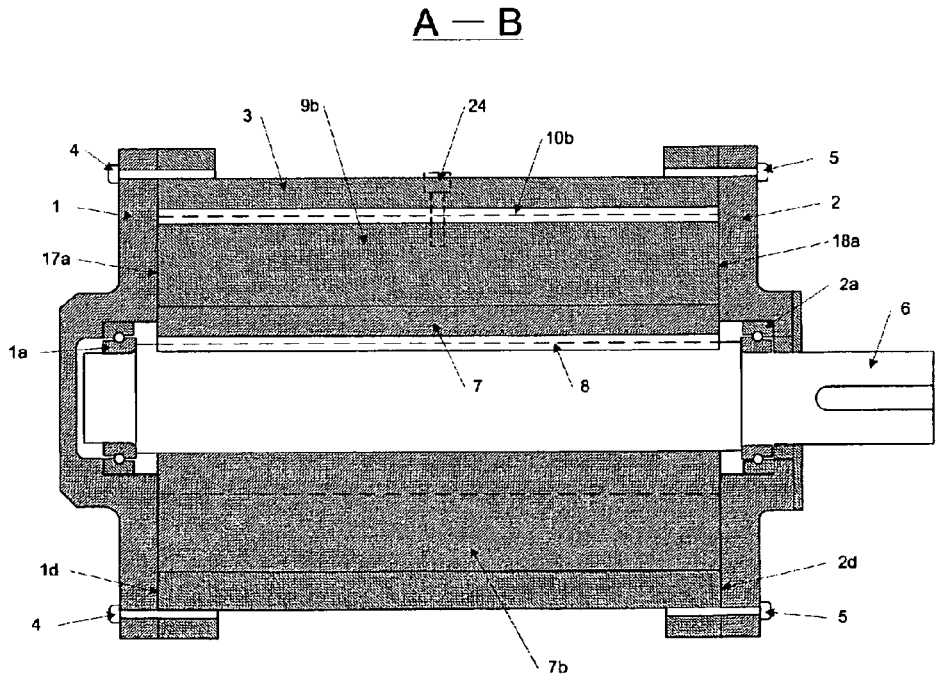
FIG. 2 is a longitudinal sectional view showing the conventional oscillating vane type pump actuator.

FIG. 1 is a cross-sectional view showing a central portion of a conventional oscillating vane type pump actuator from in the axial direction. FIG. 2 is a sectional view taken along line A-B of FIG. 1. As shown in FIG. 1, an input/output shaft 6 is installed in the central portion of the oscillating vane type pump actuator. A rotor 7 is firmly fixed on the input/output shaft 6 by a key 8. A pair of oscillating vanes 7*a* and 7*b* are provided on the rotor 7 in a straight line and integrated with the rotor 7 so that sufficient coupling strength therebetween can be ensured. A pair of fixed vanes 9*a* and 9*b* are firmly fixed by keys 10*a* and 10*b* and bolts 24 to a cylinder 3 which encloses the oscillating vanes 7*a* and 7*b*. A working chamber which increases or reduces in volume comprises four chambers; two chambers are disposed at symmetrical positions on the center axis of the shaft 6 and maintain the same pressure and repeat an increase and reduction in the volume, thus providing the function as an oscillating vane type pump actuator. To achieve the above purpose, a pair of working chambers 11*a* and 11*b* which are disposed at symmetrical positions around the center axis communicate with each other through a connection hole 16. The other pair of working chambers 12*a* and 12*b* communicate with each other through a connection hole 15. The working chambers are connected to all portions of the hydraulic system by pipes 13 and 14 which are disposed around the installation position of the fixed vane 9*b*.

FIG. 2 is a longitudinal sectional view showing the oscillating vane type pump actuator. A pair of side covers 1 and 2 that have been pointed out as a problem are provided on opposite left and right ends of the actuator. The side covers 1 and 2 use bearings 1*a* and 2*a* to support the input/output shaft 6 of the oscillating vane type pump actuator at the centers thereof. The side covers 1 and 2 are firmly fixed by a plurality of fastening bolts 4 and 5 to the cylinder 3 disposed at the medial portion. FIG. 2 is a sectional taken along line A-B, wherein although the oscillating vane 7*b* has been shown at the left side of FIG. 1 and oriented in the horizontal direction, it is shown at the bottom side in FIG. 2. In the conventional oscillating vane type pump actuator having the above-mentioned basic construction, the cylinder 3 has high strength with respect to the axial direction, that is, the left-right direction of FIG. 2, and the side covers 1 and 2 have comparatively low strength with respect to the axial direction but have high strength with respect to the radial direction of the center axis. The most important problem is that the strength is comparatively low with respect to the radial direction of the center axis. Even if the plate of the cylinder 3 is thick enough to withstand a high pressure of 25 Mpa, the entire width of the cylinder 3 is relatively small, so that the radial strength of the cylinder 3 is comparatively low. Therefore, if the oscillating vane type pump actuator is used as a main device of a power conversion means of a pendulum type high efficiency wave-power generation apparatus, because pressure is applied in the radial direction to a pressure receiving surface of the cylinder 3 that defines the high-pressure working chambers, the cylinder 3 is distorted into an ellipse-like shape in which the diameter of a portion thereof is increased. When a pendulum plate is oscillated by wave power, the four working chambers repeatedly alternate between a high-pressure side and a low-pressure side, and the direction of the ellipse-like distortion also continuously varies as time goes by. Because the side covers 1 and 2 have low axial strength, they are deformed in a shape which is swollen outwards. Thereby, the side covers 1 and 2 are slightly reduced in diameter contrary to the cylinder 3 which is distorted into an ellipse-like shape. As a result, after the actuator has been operated for a long period of time, fretting corrosion occurs on a contact surface 17*a* between the side cover 1 and the fixed vanes 9*a* and 9*b* and on a contact surface 18*a* between the side cover 2 and the fixed vanes 9*a* and 9*b*. This is a problem that must be solved as soon as possible in order to commercialize the reasonable high-efficiency wave-power generation method that the inventor of the invention has striven to achieve for a long period of time. Although it has been thought that more firmly coupling the cylinder 3 to the side covers 1 and 2 that have high radial strength will restrict the ellipse-like distortion of the cylinder 3, even if the coupling force among them is enhanced by the bolts 4 and 5, only flanges of the cylinder 3 that protrude outwards from the circumferential outer surface of the cylinder are coupled to the side covers 1 and 2. Therefore, this method is not effective at restricting the distortion, which ranges from 200 μm to 300 μm, to within the target range of several μm or less.

Figure 3:
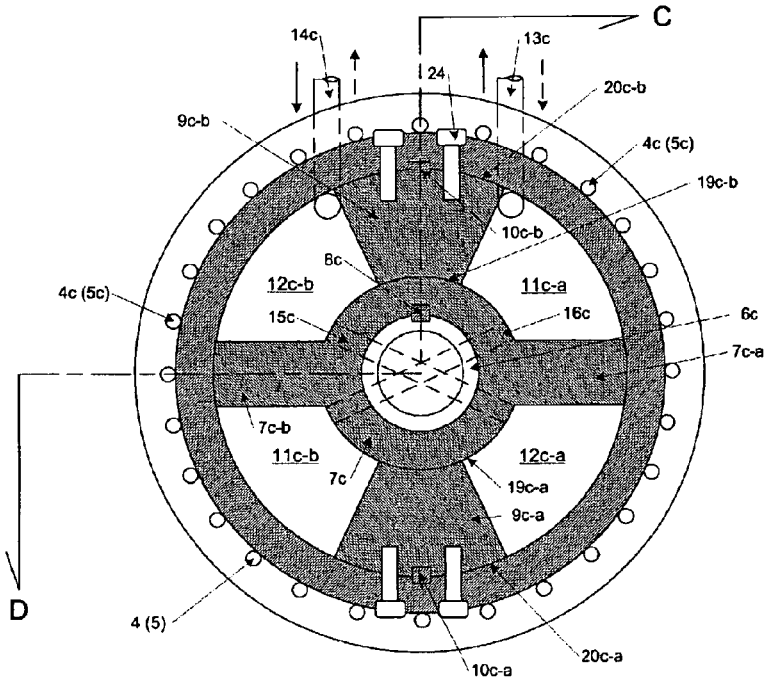
FIG. 3 is a cross-sectional view showing a central portion of an oscillating vane type pump actuator from in the axial direction, according to the present invention.

FIG. 3 is a cross-sectional view showing the central portion of a fretting-corrosion-prevention oscillating vane type pump actuator from in the axial direction according to the present invention. The construction of the pump actuator of the present invention is almost the same as that of FIG. 1. An input/output shaft 6*c* that is disposed along the center axis of the oscillating vane type pump actuator is firmly coupled to a rotor 7*c* by a key 8. A pair of oscillating vanes 7*c*-*b* and 7*c*-*a* are provided on the rotor 7 in the horizontal direction and integrated with the rotor 7 to enhance the coupling strength therebetween. A cylinder 3*c* encloses the oscillating vanes 7*c*-*b* and 7*c*-*a*. A pair of fixed vanes 9*a* and 9*b* are fixed at upper and lower positions in the cylinder 3*c* by respective keys 10*c*-*b* and 10*c*-*a* and bolts. A working chamber which increases and reduces in volume comprises four chambers. Two chambers that are disposed at symmetrical positions on the center axis communicate with each other through a communication hole 15*c*, and the other two chambers communicate with a communication hole 16*c*, so that the chambers conduct the same volume variation operation. Pipes 14*c* and 13*c* are installed around the upper fixed vane 9*c*-*b* so that the working chambers are connected to a hydraulic system by the pipes 14*c* and 13*c*. FIG. 3 shows the cut line C-D to provide a sectional view for the sake of the following description of the present invention.

Figure 4:
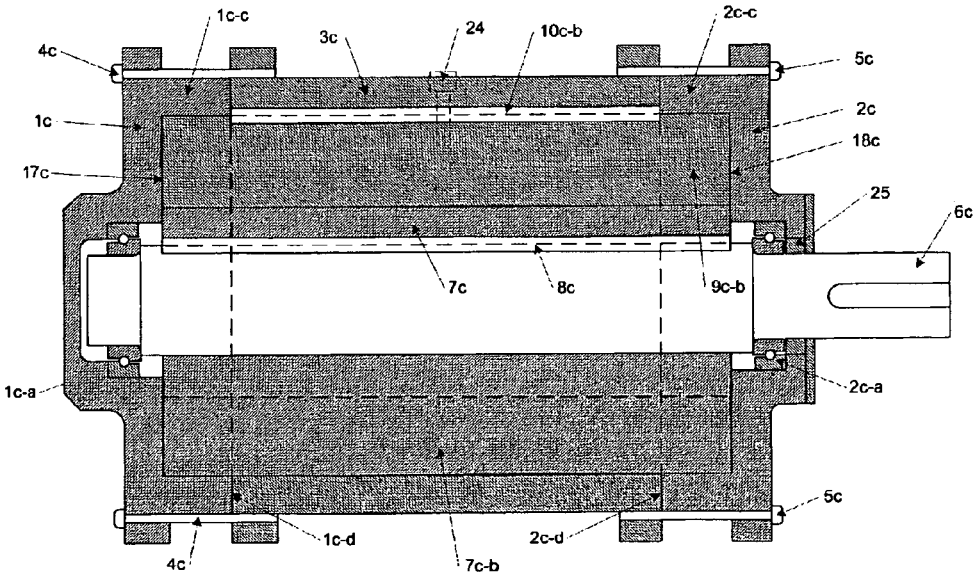
FIG. 4 is a sectional view taken along line C-D of FIG. 3.

FIG. 4 is a sectional view taken along line C-D of FIG. 3. In the same manner as FIG. 2, FIG. 4 illustrates the oscillating vane 7*c*-*b* at the bottom side although it has been shown at the left side of FIG. 3 as being oriented in the horizontal direction. The most important characteristic of the present invention is that the lengths of the opposite left and right ends of the cylinder 3*c* are shortened, and a cylindrical part is provided on each of the left and right side cover 1*c* and 2*c* to compensate for the shortened cylinder, as shown in FIG. 4. In detail, a cylindrical part 1*c*-*c* that protrudes to the right is integrally provided on the left side cover 1*c*, and a cylindrical part 2*c*-*c* that protrudes to the left is integrally provided on the right side cover 2*c*. Each of the keys 10*c*-*b* and 10*c*-*a* that fix the fixed vanes 9*c*-*b* and 9*c*-*a* to the cylinder 3*c* has the same length as that of the cylinder 3*c*, and although it is shorter than that of the conventional art, there is no problem in terms of strength. The side covers 1*c* and 2*c* support the input/output shaft 6*c* using bearings 1*c*-*a* and 2*c*-*a*. A rotary seal 25 is also provided in the right side cover 2*c* to prevent oil from leaking out of the bearing 2*c*-*a*. The left and right side covers 1*c* and 2*c* are firmly coupled to the cylinder 3*c* by a plurality of bolts 4*c* and 5*c*. Each bolt 4*c*, 5*c* is longer than that of the conventional art by the length of the cylindrical part 1*c*-*c*, 2*c*-*c* of the corresponding side cover. The bolts 4*c* and 5*c* are preferably made of a material recently commercialized which has superior corrosion resistance against sea water.

In the oscillating vane type pump actuator of the present invention having the basic construction of FIG. 4, because the elements of the working chambers are firmly joined to each other under pressure, even if distortion is caused by high pressure of work oil that is periodically applied to the working chambers, fretting corrosion can be prevented by the elements that are oriented such that high-strength directions thereof are perpendicular to each other. In the present invention, the shapes of the joining surfaces of adjacent elements that are joined to each other under pressure are the same shape. Thus, even if the oscillation of the oscillating vanes 7*c*-*b* and 7*c*-*a* in the working chamber induces a slight ellipse-like distortion of the cylinder 3*c*, the cylindrical parts 1*c*-*c* and 2*c*-*c* that are provided on the side covers 1*c* and 2*c* have the same shape as that of the cylinder 3*c* so that they can restrict the distortion of the cylinder 3*c*. Therefore, if the lengths of the cylindrical parts 1*c*-*c* and 2*c*-*c* are set appropriately, it becomes easy to restrict the strain of distortion such that it is below 20 μm to 30 μm, thus coping with fretting corrosion. Further, in the conventional oscillating vane type pump actuator, fretting corrosion also occurs on the joining surfaces between the cylinder 3 and the side covers 1 and 2. However, in the present invention, positions of the portions that are strongly joined to each other by the bolts are spaced apart from each other by the length of the cylindrical parts 1*c*-*c* and 2*c*-2 of the side covers 1*c* and 2*c*. Therefore, if the axial length of the fixed vane is set to be slightly shorter than the distance between the side covers without having a mechanical coupling means, the pressure on the junction surfaces can be easily maintained at a lower pressure.

Figure 5:
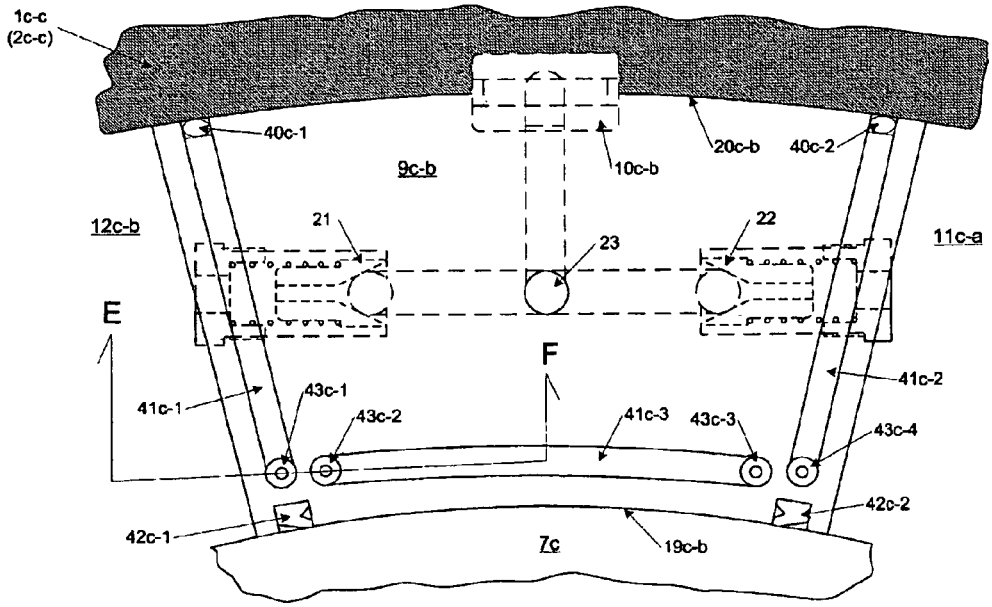
FIG. 5 is an enlarged front view showing a joining surface between a right side cover and a fixed vane of FIG. 4.

FIG. 5 is an enlarged right side view showing the joining surface between the side cover 2*c* and the fixed vane 9*c*-*b* to explain in detail the sealing structure of the fixed vane 9*c*-*b*. The fixed vane 9*c*-*b* has two kinds of seals including a seal interposed between fixed members and a seal provided on a slide surface of a slide member. In the former case, because there is no problem with abrasion of the seal, a seal which is made merely by cutting a large diameter O-ring to a predetermined size can exhibit sufficient sealing effect. A 'V'-shaped seal groove and an O-ring type fixed seals 41*c*-1 and 41*c*-2 are provided around the perimeter of the fixed vane 9*c*-*b*. Fixed seals 40*c*-1 and 40*c*-2 are respectively provided around the perimeters of the contact surfaces between the cylinder 3*c* and the cylindrical part 1*c*-*c* and between the cylinder 3*c* and the cylindrical part 2*c*-*c*. Further, a seal groove is formed in the perimeter of the cylindrical rotor 7*c* in an approximately horizontal direction so that an O-ring type fixed seal 41-3 is seated into the seal groove. A hole having a diameter greater than the width of the seal groove is formed in the end of each fixed seal in the direction perpendicular to the contact surface, and cylindrical pins 43*c*-1, 43*c*-2, 43*c*-3 and 43*c*-4 supplement the ends of the fixed seals. Furthermore, perimeter grooves having lengths corresponding to the fixed vane 9*c* are axially formed in a slide surface 19*c*-*b* of the center shaft that is a surface in sliding contact with the rotor 7*c*. Slide seals 42*c*-1 and 42*c*-2 are provided in the respective perimeter grooves. Each of these opposite slide seals has a clamp shape (<), and each of the opposite ends thereof has a lip shape. The slide seal can conduct the role of the seal to counteract any pressure applied in the direction in which the angle of the clamp shape is increased, but if the pressure is applied thereto in the direction in which the angle is reduced, the slide seal allows work oil to flow from a high pressure side to a low pressure side. As shown in FIG. 5, each of the slide seals 42*c*-1 and 42*c*-2 is oriented such that when the pressure in the adjacent working chamber is high, the angle of the clamp shape is reduced. Thus, a high-pressure side working chamber can always communicate with the slide surface 19*c*-*b* between the fixed vane 9*c*-*b* and the rotor 7*c*.

Although the above-described seal structure of the fixed vane 9*c*-*b* is almost the same as that of Patent document 2, the present invention has a hydraulic pressure structure wherein the contact surface with the corresponding side cover always communicates with a low-pressure side working chamber, thus preventing excessive contact pressure from being applied to just one of the two sides. As shown by the dashed line of FIG. 5, a pair of check valves 21 and 22 are provided in the center of the fixed vane 9*c*-*b* that faces the left and right working chambers 12*c*-*b* and 11*c*-*a*. A passage 23, through which contact surfaces 17*c* and 18*c* between the fixed vane and the side covers communicate with each other, is formed through the fixed vane. Further, the passage 23 includes passages which communicate with the check valves 21 and 22. As shown in FIG. 5, space that is not completely sealed is formed between the slide seal 42*c*-1 and the pin 43*c*-1 which are close to each other and between the slide seal 42*c*-2 and the pin 43*c*-1 which are close to each other. Further, space between the pins 43*c*-1 and 43*c*-2 cannot be completely sealed. However, because the side cover 1*c* and 2*c* and the fixed vane 9*c*-*b* are assembled such that a distance between the fixed vane 9*c*-*b* and each side cover 1*c*, 2*c* is minimized, if leakage of oil through fine gaps is limited to a predetermined level or less, the oscillating vane type pump actuator can function as an actuator that can withstand even a pressure of 25 Mpa. Each cylindrical pin 43*c*-1, 43*c*-2, 43*c*-3, 43*c*-4 is made of metal, and the surface thereof is ground to an appropriate degree, so it functions as a seal similar to a piston seal. However, work oil that infiltrates into the contact surfaces 17*c* and 18*c* between the fixed vane 9*c*-*b* and the side coves through such incomplete seal portions flows out towards a low-pressure side working chamber 12*c*-*b* or 11*c*-*b* through the check valves 21 and 22, etc. Therefore, the flow rate of work oil in the contact surfaces that are enclosed by the seals provided on the fixed vane 9*c*-*b* can be maintained to the minimum flow rate.

Figure 6:
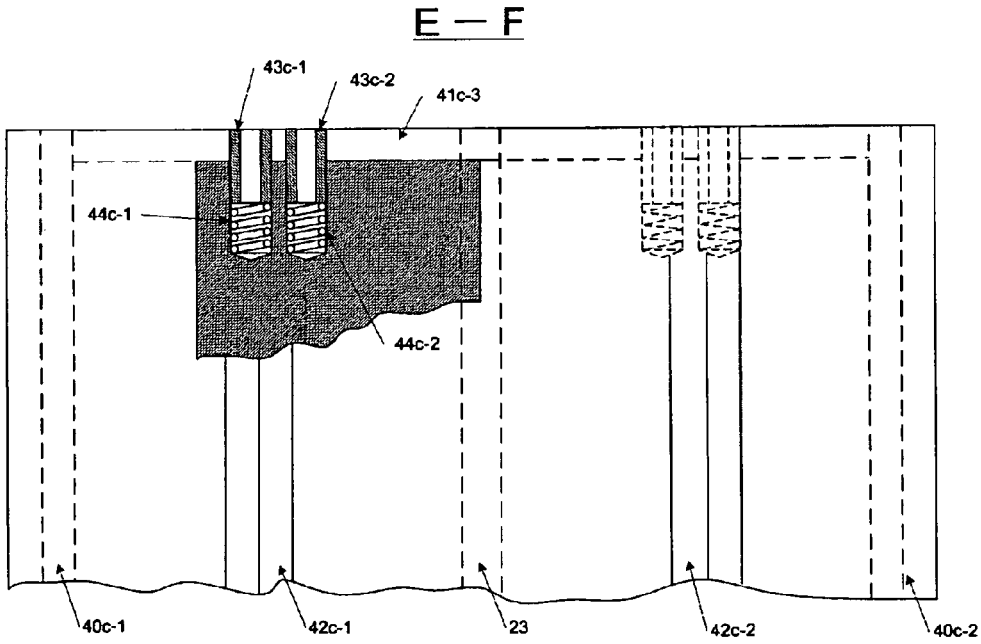
FIG. 6 is a bottom view of the fixed vane of FIG. 5 and partially shows a sectional view taken along line E-F of FIG. 5.

FIG. 6 is a bottom view of the fixed vane 9*c*-*b* and partially shows a sectional view taken along line E-F of FIG. 5. Particularly, in FIG. 6, the pins 43*c*-1 and 43*c*-2 are clearly illustrated by the partially sectional view. Each pin 43*c*-1, 43*c*-2 has a short cylindrical shape. A pin hole that receives each pin is longer than the pin. Coil springs 44*c*-1 and 44*c*-2 are provided in the lower ends of the pin holes so that the corresponding pins are biased outwards. Compared to the entire length of the fixed vane 9*c*-*b*, the length of each pin hole is shorter than that of the fixed vane 9*c*-*b*. Thus, to minimize the area of portions which are not sealed by the fixed seals 41*c*-1 and 41*c*-3 and the pin 43*c*-1 or 43*c*-2, etc., it is preferable for the distance between the pins to be kept to the minimum. In detail, the distance between the pins can be kept within a range from 1.5 mm to 2 mm.

Figure 7:
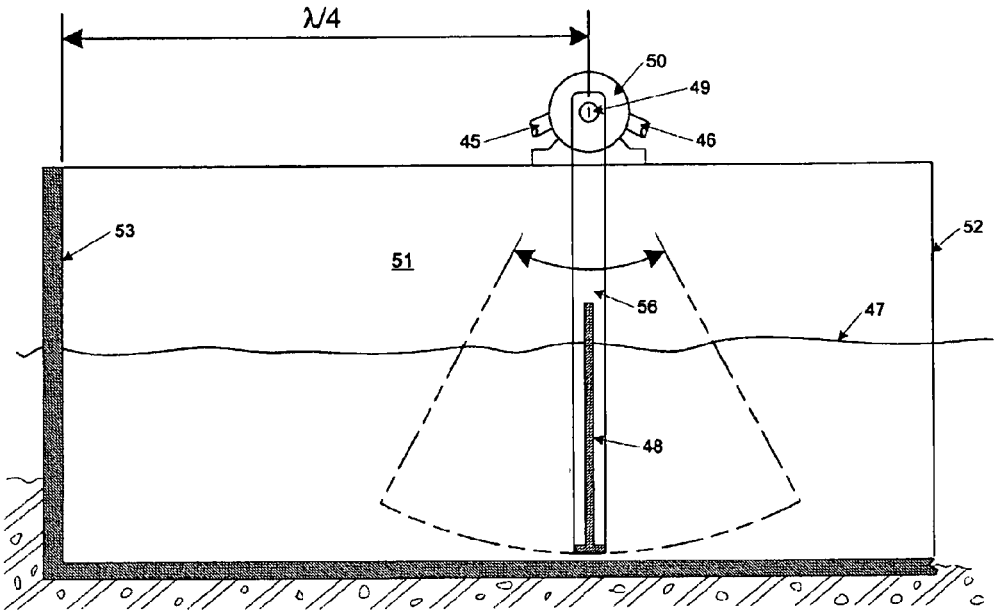
FIG. 7 is a side schematic view showing an example in which the present invention is used in a pendulum type wave-power generating apparatus which can generate power at high-efficiency.
Figure 8:
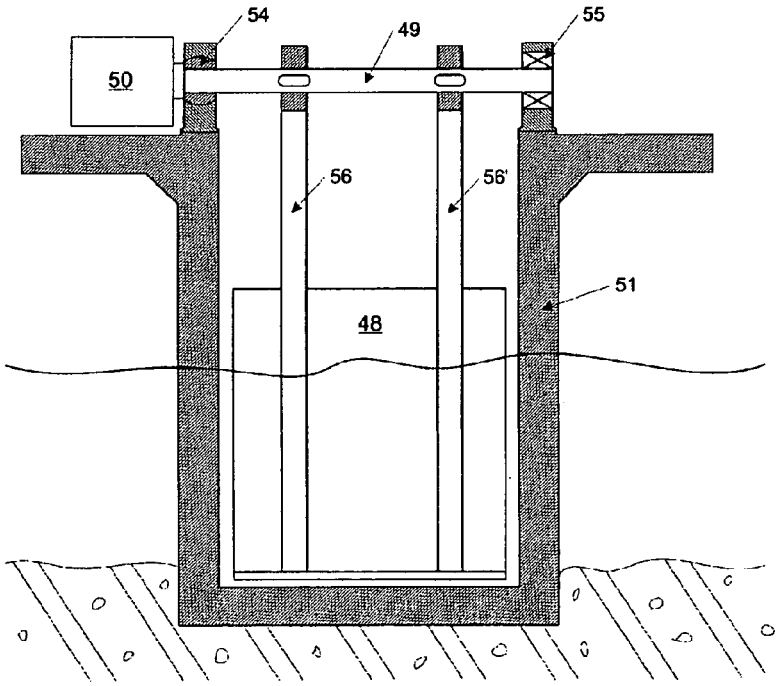
FIG. 8 is a schematic view showing the wave-power generating apparatus of FIG. 7 from the left-right direction.

FIGS. 7 and 8 are schematic views showing an example of a high-efficiency pendulum type wave-power generation apparatus using the oscillating vane type pump actuator of the present invention.

As shown in the right side of FIG. 7, an opening 52 is formed in a portion of a concrete caisson 51 that faces the sea so that waves 47 can be guided into the caisson 51 by the opening 52. The left end of the caisson 51 is a fixed wall 53 which reflects waves that enter the caisson 51 from the right side. An incident wave that has been reflected by the fixed wall 53 becomes a reverse-directional reflected wave. As a result of interference between the incident waves and the reflected waves, a singular point, at which the wave height is always zero and horizontal kinetic energy is doubled, is formed at a position which is ¼ of the entire wave length. An oscillating shaft 49 of the pendulum plate 48 which receives wave-power is disposed at this singular point. An oscillating vane pump 50 that uses the present invention is integrally provided on one end of the oscillating shaft 49 to be used as the pump of a generator drive hydraulic system. Because most of the wave energy is applied in the horizontal direction to the vicinity of the pendulum plate 48, the wave power can be efficiently transmitted to the oscillating vane pump 50 via the oscillating shaft 49 and input to the hydraulic system in such a way that it is converted into rotary motion of the generator using high-pressure work oil that flows along pipes 45 and 46.

FIG. 8 is a schematic view illustrating the caisson of FIG. 7 in the direction from the fixed wall 35 towards the opening 52 so as to facilitate the understanding of the arrangement of the main elements of the apparatus. The width of the pendulum plate 48 is slightly less than that of the opening of the concrete caisson 51, and the pendulum plate 48 is attached to a pair of strong support rods 56 and 56'. The upper ends of the support rods 56 and 56' are firmly fixed to the oscillating shaft 49. A pair of main bearings 54 are provided on the caisson 51 to support the oscillating shaft. The oscillating vane pump 50 of the present invention is integrally coupled to the left end of the oscillating shaft 49. The main bearing 54 comprises a spherical bearing having a comparatively large diameter, so that the site work of installing the main elements of the apparatus including the pendulum plate and the main shaft on the caisson 51 can be facilitated, thus reducing the working time.

Figure 9:
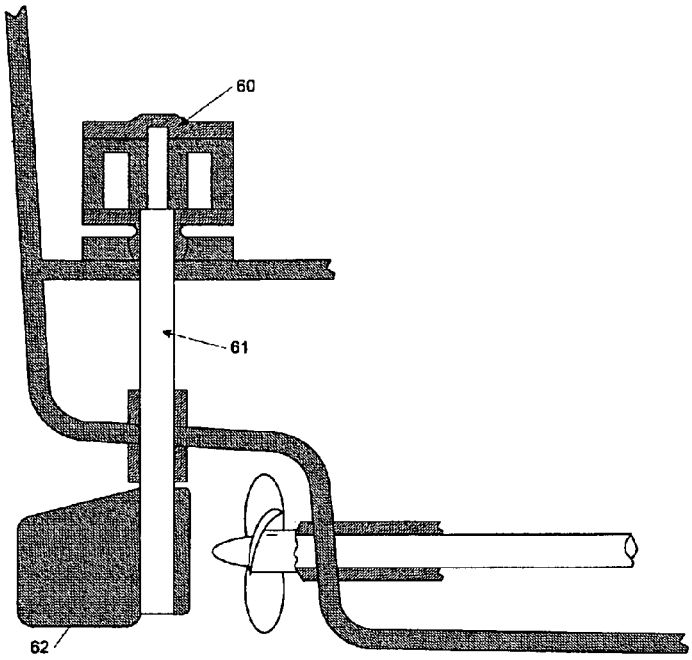
FIG. 9 is a schematic view showing an example in which the present invention is used in a rudder control device of a large ship.

FIG. 9 illustrates an example in which the oscillating vane type pump actuator of the present invention is used as an actuator for driving a steering device of a large ship. FIG. 9 is a sectional view of a lower portion of the stern of the ship. Because the space in the ship is limited and the actuator 60 for the rudder 62 requires a large amount of oscillating power, using the oscillating vane type pump actuator of the present invention as the actuator 60 can optimize the design of the peripheral elements. If the actuator 60 is directly connected to a main rudder shaft 61, regardless of the oscillating position of the rudder 62, the rate of variation in the flow rate of work oil always coincides with the rate of variation of the angle of the rudder 62. Further, the structure wherein the rudder 62 and the actuator 60 are directly connected to each other using the main rudder shaft 61 makes the responsivity between the rudder 62 and the actuator 60 superior. In addition, because the actuator is of high pressure of 25 Mpa, it realizes a very compact steering device, thus making better use of space in the ship, and being more economical. Even if a high-pressure hydraulic cylinder which is being sold in the market is used as the actuator, the flow rate of work oil that is required to change the angle of the rudder to a predetermined angle may become different, and because there is a difference in the volume of the working chamber between when manipulating the rudder in the clockwise direction and the counterclockwise direction, precise control of the pressure and flow rate is required, thus making a control system complex. Although advantages of the use of oscillating vane type pump actuators in steering devices have been well known and the expectations regarding commercialization have been high, a product having specifications for high-pressure has not been commercialized. If the oscillating vane type pump actuator of the present invention can lead to a low-cost mass production system, high economic effects resulting from exploitation of a new market are also expected. Moreover, in the hydraulic machine industry which has been reduced by the trend to favor energy-saving technology, a high power compact oscillating vane actuator for oscillation-driving a hinge unit of a large robot for high-rise work, which has not been able to be realized by the conventional technology, can be realized. Therefore the present invention can be a new technology which counteracts the shrinking of the market.

The invention claimed is:

1. A fretting-corrosion-prevention oscillating vane type pump actuator, comprising:

a cylinder;

a pair of side covers provided on opposite ends of the cylinder, the side covers adapted to resist radial distortion to a greater extent than the cylinder when a load is applied to the pump actuator in the radial direction;

an oscillating shaft supported by central portions of the pair of side covers, the oscillating shaft protruding outwards from one side cover;

a fixed rotor fitted over the oscillating shaft;

an oscillating vane integrated on the fixed rotor; and a fixed vane fixed to the cylinder and brought into close contact with the cylinder and the pair of side covers by fixed seals, the fixed vane having a slide surface that makes contact with a circumferential outer surface of the rotor by means of a slide seal, wherein the cylinder is shorter at opposite ends thereof than a length of the rotor, the opposite ends being shorter by a same length, the pair of side covers are integrated with respective cylindrical parts which extend inwards by a same length by which the lengths of the opposite ends of the cylinder are shortened, to compensate for the shorter length of the cylinder, and wherein the cylindrical parts undergo radial distortion when a load is applied in the radial direction to the pump actuator, thereby preventing fretting corrosion at surfaces of the cylinder that contact the cylindrical parts; and a passage passing through the fixed vane, the passage being open on junction surfaces between the fixed vane and the opposite side covers, and a pair of check valves operatively coupled to the passage wherein the pair of check valves face opposite working chambers having opposing hydraulic pressures, wherein each of the pair of check valves is oriented in a direction which prevents communication with the working chamber at a high pressure side and allows communication with the working chamber at a low pressure side.

* * * * *